US005855428A

United States Patent [19]

Wilkins

[11] Patent Number: 5,855,428

[45] Date of Patent: Jan. 5, 1999

[54] APPARATUS FOR OBTAINING A DESIRED TINT

[75] Inventor: Arnold Jonathan Wilkins, Cambridge, England

[73] Assignee: Medical Research Council, London, England

[21] Appl. No.: 845,789

[22] Filed: Apr. 25, 1997

[30] Foreign Application Priority Data

Apr. 25, 1996 [GB] United Kingdom ..... 9608476

[51] Int. Cl.[6] ..... F21V 9/00

[52] U.S. Cl. ..... 362/293; 362/33; 362/2; 362/284

[58] Field of Search ..... 362/293, 33, 2, 362/284

[56] References Cited

U.S. PATENT DOCUMENTS

| | | | |
|---|---|---|---|
| 845,568 | 2/1907 | Nielsen . | |
| 1,102,160 | 6/1914 | McFarlan . | |
| 2,443,510 | 6/1948 | McCallum . | |
| 3,816,739 | 6/1974 | Stolov | 240/10 R |
| 4,255,045 | 3/1981 | Eisenberg | 355/37 |
| 4,958,265 | 9/1990 | Solomon | 362/293 |
| 5,188,452 | 2/1993 | Ryan | 362/293 |
| 5,282,115 | 1/1994 | McGuire | 362/2 |
| 5,528,431 | 6/1996 | Wilkins | 359/885 |

FOREIGN PATENT DOCUMENTS

WO 92/01416 2/1992 United Kingdom .

*Primary Examiner*—Ira S. Lazarus
*Assistant Examiner*—David Lee
*Attorney, Agent, or Firm*—Dickinson Wright PLLC

[57] ABSTRACT

Apparatus for obtaining a desired tint comprising light colouring means in the form of a cylinder having a number of different regions of respective different colours forming a ring around the axis of the cylinder, and region which is neutral as regards colour, which forms a ring around the axis of the cylinder, and which is adjacent to all the coloured regions. A light source directs light towards the cylinder, an aperture defining a selected region of the cylinder which affects the light which creates the desired tint. First movement control means are operable to effect rotation of the cylinder about its axis to effect a change in the hue of the tint without changing the saturation thereof, and said second movement control means are operable to effect axial movement of the cylinder to effect a change in the saturation in the tint without changing the hue thereof.

11 Claims, 4 Drawing Sheets

APPARATUS FOR OBTAINING A DESIRED TINT

The present invention relates to apparatus for obtaining a desired tint.

One such apparatus proposed hitherto comprises an intuitive calorimeter, and is described in detail in United Kingdom Patent No. 2,246,427.

One disadvantage of such a calorimeter is the extent to which the tint which can be obtained by it corresponds to tints which can actually be obtained by means of filters provided in ophthalmic spectacles.

A further disadvantage of the previously proposed calorimeter is that the spectral energy distribution which makes up a given tint varies for different nominal saturation levels of a given nominal hue.

Means have also been proposed hitherto for use in theatrical lighting which vary a tint obtained by movement of filters in front of a spotlight, but which have not readily resulted in a constant brightness whilst the saturation of a given hue is changed.

The present invention seeks to provide a remedy for one or other of the foregoing disadvantages.

Accordingly, the present invention is directed to apparatus for obtaining a desired tint comprising light colouring means having, at least, a first region of a first colour, a second region of a second colour adjacent to the first region, and a third region adjacent to both the first and second regions, the third region being generally neutral as regards colour, a light source to direct light towards the colouring means, an aperture defining a selected region of the colouring means which affects the light which creates the desired tint, and first and second movement control means to effect relative movement between the said aperture and the said colouring means, the first movement control means effecting such movement in a direction from one of the first and second regions to the other, and the second movement control means effecting such movement in a direction from the coloured regions to the neutral region or from the neutral region to the coloured regions.

Preferably the colouring means form a hollow cylinder with the light source being positioned therewithin. For example the light source may comprise one or more fluorescent tubes extending in an axial direction within the cylinder.

Preferably there are more than two regions of different colour, and preferably the difference in the hue angle (Commission Internationale de l'Eclairage, 1976 hue angle, $h_{uv}$) between any and every two regions which are adjacent is the same. Most desirably there are six or more regions, preferably seven, of respective different colour arranged around the axis of the cylinder with the neutral region also extending around the axis of the cylinder, and being adjacent to the coloured regions.

The cylinder may be positioned adjacent to an aperture of a mixer box the interior surfaces of which are white or are generally neutral as regards colour, the box having a plurality of surfaces whereby light from the cylinder is mixed by multiple reflections so that the light within the box is of a uniform tint. A second aperture of the box enables an individual to view a tint within the box. A support may be provided for a book or other object which can be viewed by the user through the second aperture. The support may be simply one of the box's interior surfaces.

In the event that the colouring means are in the form of a cylinder, axial movement of the cylinder may effect a change in the saturation in the tint without changing the hue thereof, whereas a rotation of the cylinder about its axis may change the hue of the tint without changing the saturation thereof.

With such controls, the user may readily find the tint which he is most comfortable with.

The order of the colours of the coloured regions, for six such regions, progressing in a given direction around the cylinder may be as follows:

yellow, orange, rose, purple, blue, green.

For seven such regions, the order may be as follows:

yellow, orange, rose, purple, blue, turquoise, green.

In this case, especially the blue and green filters will be shifted in hue angle relative to the blue and green filters for the six colour cylinder.

An example of apparatus made in accordance with the present invention is shown in the accompanying drawings in which.

Figure 1:
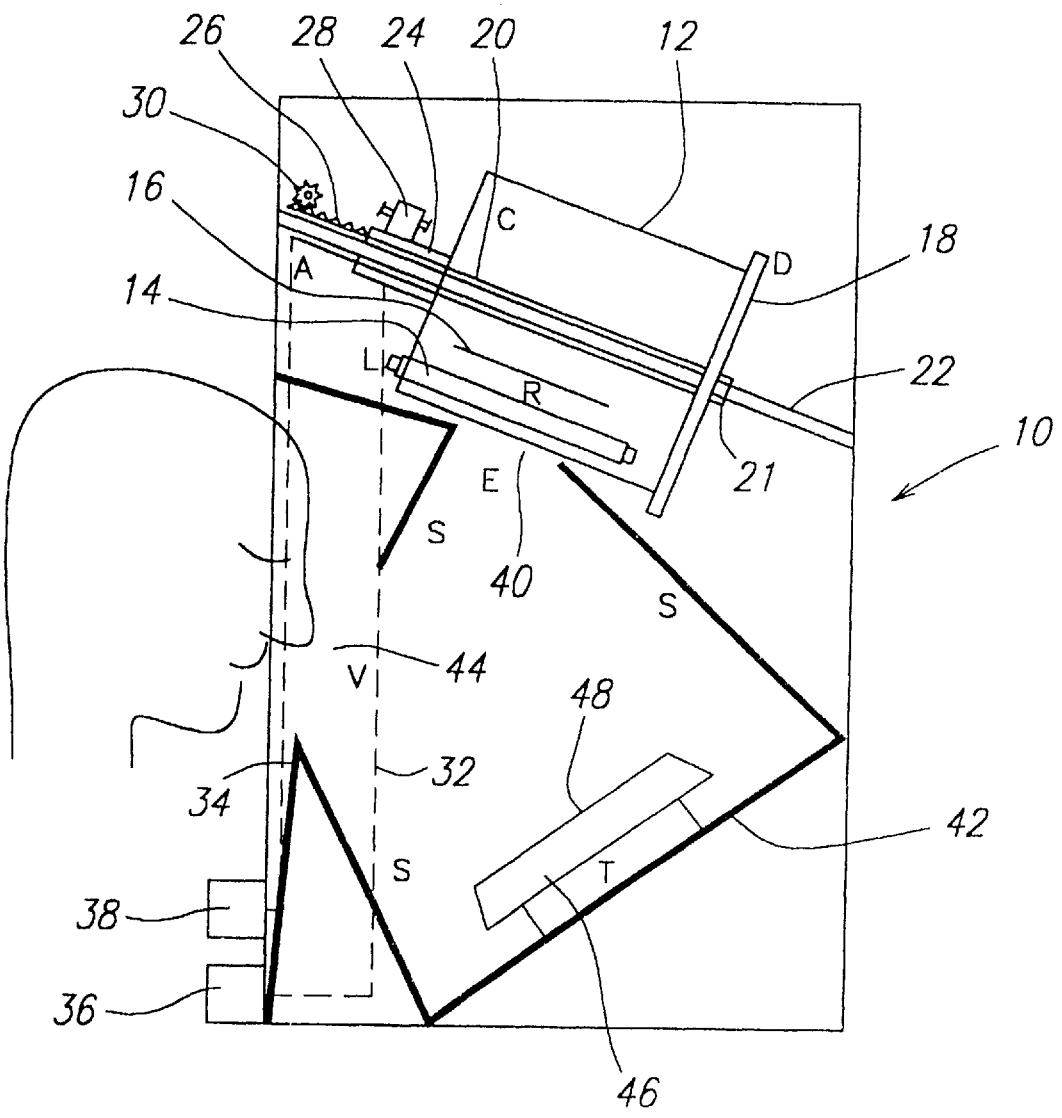
FIG. 1 shows an elevational generally diagrammatical view of the apparatus.
Figure 2:
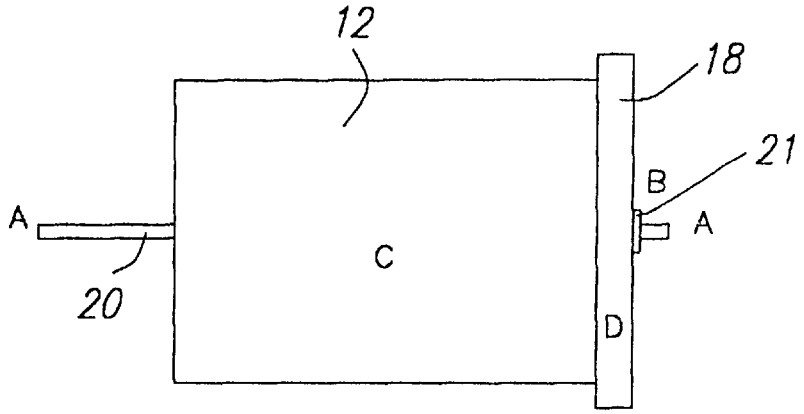
FIG. 2 shows on an enlarged scale, a side view of a part of the apparatus shown in FIG. 1.
Figure 3:
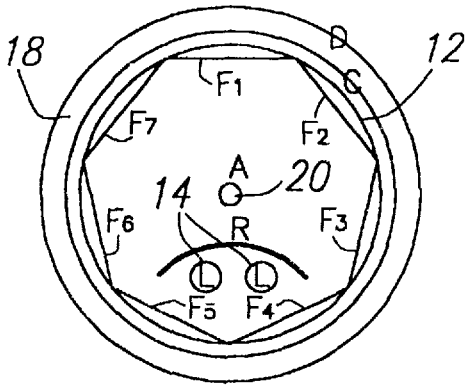
FIG. 3 shows an end view of the part shown in FIG. 2.
Figure 4:
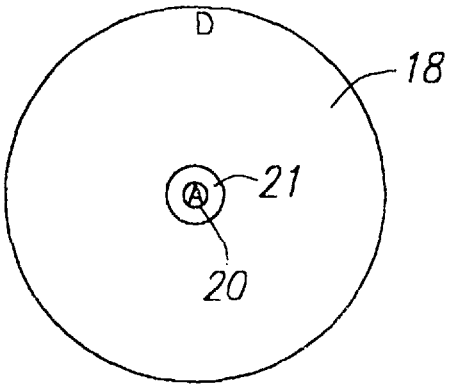
FIG. 4 shows the opposite end view of that part.
Figure 5:
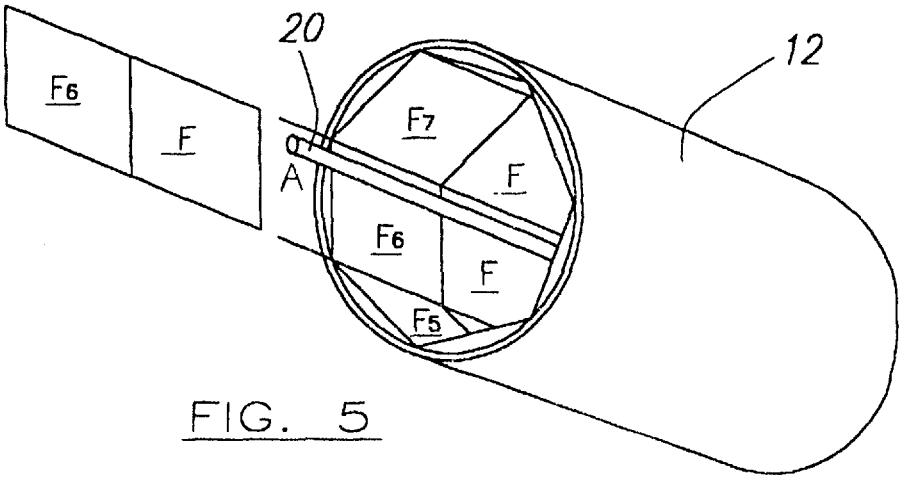
FIG. 5 shows a perspective view of the part shown in FIG. 2 into the interior thereof.

The apparatus 10 shown in FIG. 1 comprises a generally hollow cylindrical translucent perspex filter part 12 through the interior of which, and below the axis of which extend two fluorescent lights 14 which are parallel to one another, which are spaced apart in an intended horizontal direction and which are parallel to and below the axis of the cylinder 12. An arcuate-sectioned concave elongate reflector 16 is positioned to direct light from the fluorescent tubes 14 downwardly. The cylinder 12 is supported at one end on a disc 18 which itself is held fast to a cylindrical sleeve 20 extending along the axis of the cylinder 12, by a metal bush 21. Within the sleeve 20 extends a fixed support rod 22 about which the sleeve 20, the disc 18 and the cylinder 12 can rotate, and also slide along.

One end of the sleeve 20 is provided with a series of spline teeth 24 spaced apart around the sleeve, and a series of annular teeth 26 spaced apart axially along the sleeve 20. Respective cog wheels 28 and 30 which engage the teeth 24 and 26 can therefore control rotation and axial movement of the cylinder 12 respectively. Mechanical and/or electrical links 32 and 34 respectively link the cog wheels 28 and 30 to hand controls 36 and 38, enabling the user to move the cylinder 12 rotationally and axially respectively. The extent of available travel of the cylinder 12 in its axial direction is substantially equal to the dimension of the aperture 40 in the plane of FIG. 1.

The cylinder 12 is positioned above a first aperture 40 in a light box 42. The latter has a plurality of internal surfaces which are matte white or which are otherwise neutral as regards colour, and are so arranged to cause mixing of light from the cylinder 12 by multiple reflections. A second aperture 44 is provided to enable the user to view the tint thus created within the light box 42. A support 46 may be provided within the light box for printed material 48 to be viewed by the user through the aperture 44, with the light of the given tint illuminating such printed material.

Further details of the cylinder 12 are shown in FIGS. 2 to 6. It will be seen from these that the cylinder 12 is generally transparent, and is provided with a series of coloured filters F1 to F7 arranged uniformly around the cylinder 12 in that order F1 to F7 such that each coloured filter is contiguous with two others. These differently coloured filters constitute a first ring on the left of the cylinder 12 viewing it as in FIG. 2. Thus the filters F1 to F7 effectively constitute a cylinder themselves within the cylinder 12. They are coloured respectively as follows:

yellow, orange, rose, purple, blue, turquoise, green.

The difference in the hue angle (Commission Internationale de l'Eclairage, 1976 hue angle, $h_{uv}$) between each two adjacent filters is the same, or expressed another way the filters have evenly spaced chromaticity. Further corresponding filter portions F' which are all neutral in colour constitute a ring around the right hand side of the cylinder 12 viewing it as in FIG. 2, the two rings being contiguous. Both the coloured and neutral filters have a photopic transmission of about 25%.

Figure 6:
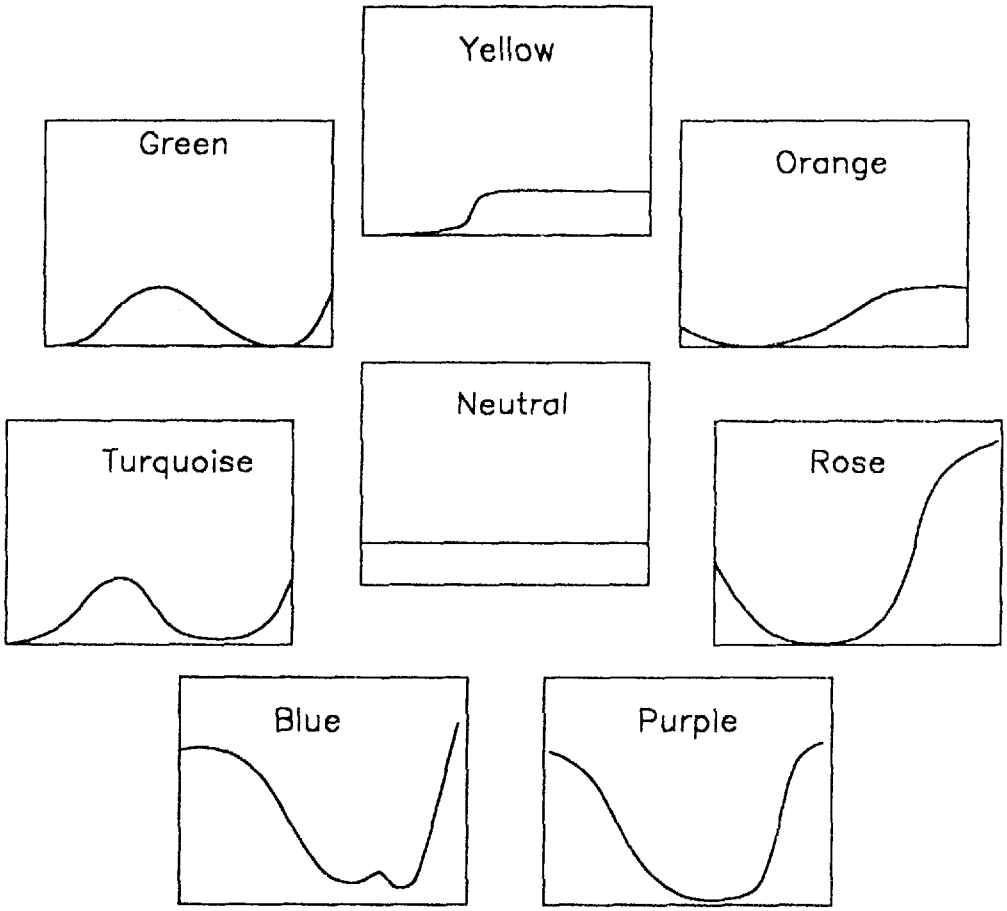
FIG. 6 shows a series of curves representative of the transmission characteristics of different regions of the part shown in FIG. 2.

The approximate transmission characteristics of each of the filters is shown in the graphs of FIG. 6 for each of the colours. In each graph of FIG. 6, the x-axis represents the wavelength from 400 to 700 nanometers and the y-axis shows the transmission from 0 to 100%. Thus, in each graph shown in FIG. 6, the height of the curve represents the transmissivity of the filter as a function of wavelength.

Figure 7:
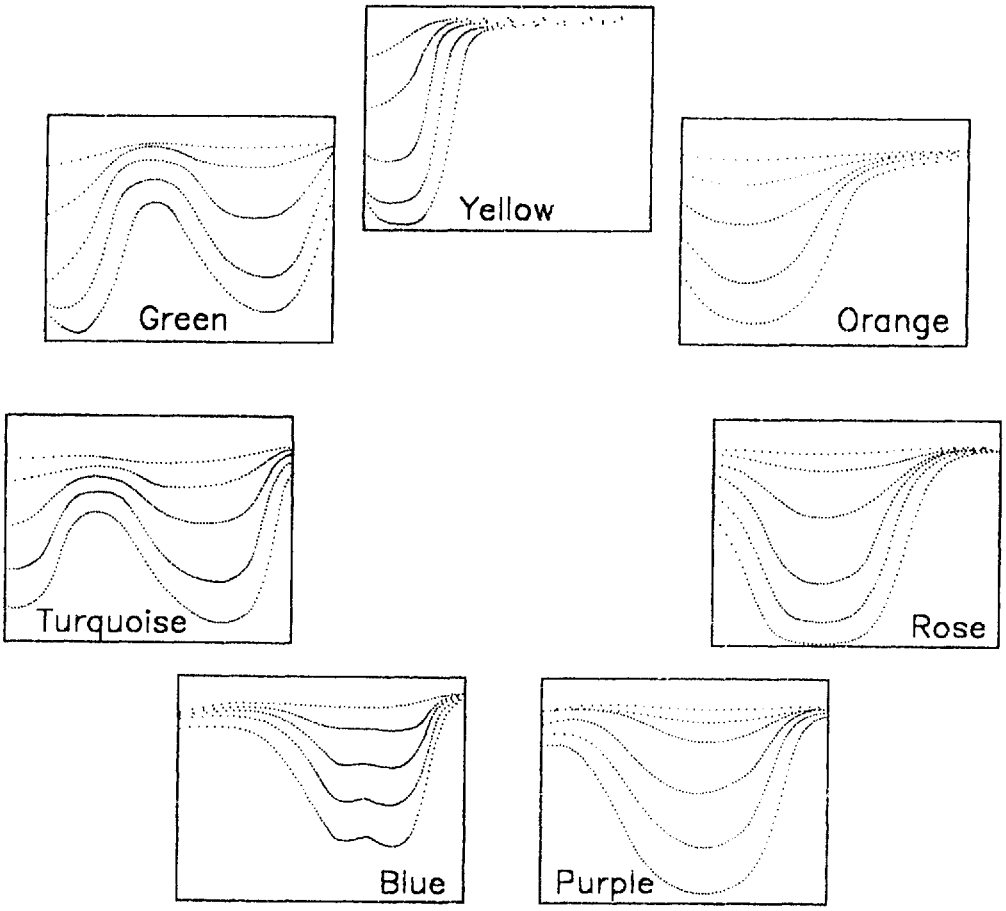
FIG. 7 shows curves of alternative different transmission characteristics.
Figure 8:
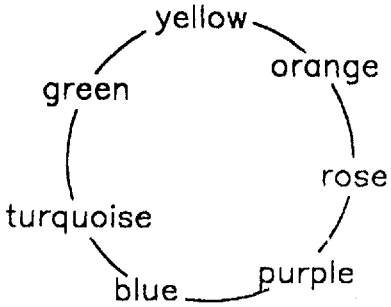
FIG. 8 illustrates the arrangement of alters on the apparatus shown in FIG. 3.

FIG. 7 shows a series of other alternative possible transmission characteristics with the axis representing the same parameters as in FIG. 6, but with the graphs showing the transmission characteristics at different stages of deposition of respective ophthalmic dyes within an ophthalmic lens.

It will be seen the user can operate the hand control 36 to effect rotary movement of the cylinder 12 and thereby alter the hue continuously and evenly without altering the saturation of the tint within the light box 42.

Because the depth of the aperture 40 in a direction perpendicular to the plane of FIG. 1 is substantially equal to the width of each filter F1 to F7, and because adjacent colours in the filter part 12 are contiguous along a straight, axially extending line, the light passing through the aperture 40 through the coloured filters may be all of one colour, or all of the next adjacent colour, or any continuously variable proportions of the two.

At the same time the user can operate control 38 to vary the saturation of the tint linearly without altering the hue. The degree of possible variation of saturation is from 100%, when only one or two coloured filters are positioned over the aperture 40, to 0% when only neutral filters are so positioned. Furthermore, whilst the user moves the cylinder 12 axially, he or she can alter the saturation of the tint obtained in such a manner that the variation of the tint, particularly in terms of its spectral power distribution, follows that which would be obtained by changing the degree of deposition of the dyes appropriate for the hue he has selected, in an ophthalmic lens. It does this more precisely than previous constructions.

Since all the filters, coloured and neutral, have a phototropic transmission of about 25%, variations of hue and/or saturation do not vary luminance by any significant amount.

Brightness may be varied by placing a neutral filter or filters (not shown), additional to the filter portion of the cylinder 12, over the aperture 40 or appropriately elsewhere in the light path from the tubes 14 to the light box 42.

I claim:

1. Apparatus for obtaining a desired tint having a given hue and a given saturation, comprising light colouring means having, at least, a first region of a first colour, a second region of a second colour adjacent to the first region, and a third region adjacent to both the first and second regions, a light source to direct light towards the colouring means, an aperture defining a selected region of the colouring means which affects the light which creates the desired tint, and first and second movement control means to effect relative movement between the said aperture and the said colouring means, wherein the colouring means form a hollow cylinder with the light source being positioned therewithin, wherein the third region is a generally neutral region as regards colour, wherein the regions of respective different colour extend around the longitudinal axis of the hollow cylinder with the neutral region also extending around the hollow cylinder and being adjacent to but axially displaced from the regions of respective different colour, and wherein the said first movement control means are operable to effect relative rotation of the hollow cylinder about the longitudinal axis thereof to effect a change in the hue of the tint without changing the saturation thereof, and the said second movement control means are operable to effect relative axial movement of the cylinder to effect a change in the saturation in the tint without changing the hue thereof.

2. Apparatus according to claim 1, wherein the light source comprises at least one fluorescent tube extending in an axial direction within the cylinder.

3. Apparatus according to claim 1, wherein there are more than two regions of different colour.

4. Apparatus according to claim 3, wherein there are six or more such regions.

5. Apparatus according to claim 4, wherein there are six such regions, the colours of which are, progressing in a given direction around the hollow cylinder, as follows:

yellow, orange, rose, purple, blue, green.

6. Apparatus according to claim 4, wherein there are seven such regions.

7. Apparatus according to claim 6, wherein the colours of the seven regions are, progressing in a given direction around the hollow cylinder, as follows:

yellow, orange, rose, purple, blue, turquoise, green.

8. Apparatus according to claim 3, wherein the difference in the hue angle between any and every two regions which are adjacent is the same.

9. Apparatus according to claim 1, wherein the hollow cylinder is positioned adjacent to an aperture of a mixer box the interior surfaces of which are generally neutral as regards colour, the box having a plurality of surfaces whereby light from the cylinder is mixed by multiple reflections so that the light within the box is of a uniform tint, the box having a second aperture enabling an individual to view a tint within the box.

10. Apparatus according to claim 9, wherein a support is provided in the box for an object which can be viewed by the user through the second aperture.

11. Apparatus according to claim 10, wherein the support is one of the interior surfaces of the box.

* * * * *